US009861205B2

(12) United States Patent
Hector et al.

(10) Patent No.: US 9,861,205 B2
(45) **Date of Patent: *Jan. 9, 2018**

(54) ARMREST MECHANISM FOR A CHAIR

(71) Applicant: Knoll, Inc., East Greenville, PA (US)

(72) Inventors: Andrew Hector, Red Hill, PA (US); Khalid Masoud, Souderton, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/098,461

(22) Filed: Apr. 14, 2016

(65) Prior Publication Data

US 2016/0227936 A1 Aug. 11, 2016

Related U.S. Application Data

(63) Continuation of application No. 14/666,583, filed on Mar. 24, 2015, now Pat. No. 9,351,575.

(60) Provisional application No. 61/978,329, filed on Apr. 11, 2014.

(51) Int. Cl.
*A47C 7/54* (2006.01)
*A47C 1/03* (2006.01)

(52) U.S. Cl.
CPC . *A47C 7/54* (2013.01); *A47C 1/03* (2013.01)

(58) Field of Classification Search
CPC ..... A47C 7/54; B60N 2/4626; B60N 2/464
See application file for complete search history.

(56) References Cited

U.S. PATENT DOCUMENTS 4,951,995 A 8/1990 Teppo et al.
5,265,938 A 11/1993 Melhuish et al.
5,382,079 A 1/1995 Wilson et al.
5,393,125 A 2/1995 Watson et al.
5,484,187 A 1/1996 Doerner et al.
5,599,067 A 2/1997 Schuelke et al.
5,664,842 A 9/1997 Tseng
(Continued)

FOREIGN PATENT DOCUMENTS

DE 29901666 4/2000
WO 2009018402 A1 2/2009

OTHER PUBLICATIONS

International Search Report for PCT/US2015/022369 dated Jun. 25, 2015.

(Continued)

*Primary Examiner* — Philip F Gabler

(74) *Attorney, Agent, or Firm* — Buchanan Ingersoll & Rooney PC

(57) ABSTRACT

An armrest for a chair includes a first slideable member moveably positioned within a support post and a second slideable member moveably positioned within the support post. The first slideable member is moveably positioned within a channel of the second slideable member such that the first slideable member is moveable relative to the second slideable member. An actuator is connected to the first and second slideable members. The actuator can optionally be included that is actuatable from a locked position to an unlocked position. The first and second slideable members are immovable within the post when the actuator is in the locked position and the first and second slideable members are moveable within the post when the actuator is in the unlocked position.

23 Claims, 10 Drawing Sheets

(56) References Cited

U.S. PATENT DOCUMENTS

| | | | | |
|---|---|---|---|---|
| 5,676,483 | A | 10/1997 | Koubek | |
| 5,735,577 | A | 4/1998 | Lin | |
| 5,765,920 | A | 6/1998 | Lai | |
| D398,174 | S | 9/1998 | Fahnstrom et al. | |
| 5,951,107 | A | 9/1999 | Tornero | |
| 6,076,892 | A | 6/2000 | van Hekken et al. | |
| 6,209,840 | B1 * | 4/2001 | Chen | A47C 1/03 248/118 |
| 6,394,553 | B1 | 5/2002 | McAllister et al. | |
| 6,419,323 | B1 | 7/2002 | Chu et al. | |
| 6,540,300 | B2 | 4/2003 | Piretti | |
| 6,802,566 | B2 | 10/2004 | Prince et al. | |
| 6,824,218 | B1 | 11/2004 | van Hekken | |
| 6,877,813 | B2 | 4/2005 | Caruso et al. | |
| 7,156,466 | B1 * | 1/2007 | Chang | A47C 1/03 297/115 |
| 7,234,779 | B2 | 6/2007 | Bedford et al. | |
| 7,246,859 | B2 * | 7/2007 | Igarashi | A47C 1/03255 297/411.36 |
| 7,434,887 | B1 | 10/2008 | Hsien | |
| 7,556,316 | B1 * | 7/2009 | Lai | A47C 1/03 297/411.2 |
| 7,828,389 | B2 | 11/2010 | Oda | |
| 7,980,631 | B2 | 7/2011 | Diffrient | |
| 8,246,117 | B2 | 8/2012 | Melhuish et al. | |
| 2007/0164595 | A1 * | 7/2007 | Chi | A47C 1/03 297/411.36 |
| 2008/0191537 | A1 | 8/2008 | Oda | |
| 2008/0309140 | A1 * | 12/2008 | Ho | A47C 1/03 297/411.36 |
| 2009/0096271 | A1 | 4/2009 | Tsai | |
| 2010/0038950 | A1 | 2/2010 | Lee | |
| 2011/0248542 | A1 | 10/2011 | Tsai | |
| 2012/0098318 | A1 * | 4/2012 | Chen | A47C 1/03 297/411.36 |

OTHER PUBLICATIONS

Written Opinion of the International Searching Authority for PCT/US2015/022369 dated Jun. 25, 2015.

* cited by examiner

ARMREST MECHANISM FOR A CHAIR

CROSS-REFERENCE TO RELATED APPLICATIONS

The present application is a continuation of U.S. patent application Ser. No. 14/666,583, which was filed on Mar. 24, 2015 and claims priority to U.S. Provisional Patent Application No. 61/978,329, which was filed on Apr. 11, 2014.

FIELD OF INVENTION

The present invention relates to chairs. More particularly, to an armrest mechanism of a chair that is configured to permit the height of the pad of the armrest to be vertically adjustable.

BACKGROUND OF THE INVENTION

Chairs often include armrests. The armrests may be affixed immovably to the chair or may be attached to the chair such that the armrests are adjustable. Examples of chairs that include armrests can be appreciated from U.S. Pat. Nos. 8,246,117, 7,980,631, 7,828,389, 7,234,779, 6,877,813, 6,824,218, 6,802,566, 6,540,300, 6,394,553, 6,076,892, 5,676,483, 5,599,067, 5,484,187, 5,393,125, 5,265,938, 4,951,995, and D398,174

SUMMARY OF THE INVENTION

An armrest for a chair is provided as well as a chair that includes one or more such armrests. Embodiments of the armrests can include an actuator that is moveable from a locked position to an unlocked position that is connected to first and second slideable members that are extendable and retractable from a first channel of a support post sized for attachment to an element of a chair when the actuator is moved to the unlocked position. The first and second slideable members can be attached to the actuator such that they are prevented from moving when the actuator is in the locked position. An arm pad can be attached to the first slideable member so that the arm pad is moved vertically during vertical movement of the first slideable member.

During arm pad height adjustment of the arm pad for some embodiments of the armrest, the first slideable member can be moveable relative to the second slideable member during extension out of the post as the arm pad is moved upwards. Once the first slideable member reaches an extended-most position out of a second channel of the second slideable member, the second slideable member can be moveable relative to the post to extend further out of the post such that both the first and second slideable members move further outward of the post together until the second slideable member reaches its uppermost position within the channel.

In some embodiments, an armrest for a chair can include a support post sized and configured for attachment to a chair, the post having a first inner channel; a first slideable member moveably positioned within the first channel; and a second slideable member moveably positioned within the first channel, the second slideable member having a second channel. The first slideable member can be moveably positioned within the second channel such that the first slideable member is moveable relative to the second slideable member. An actuator can be connected to the first and second slideable members that is actuatable from a locked position to an unlocked position. The actuator can be connected to the first and second slideable members such that when the actuator is in the locked position the first and second slideable members are immovable within the first channel and the first slideable member is immovable relative to the second slideable member within the second channel. The actuator can be connected to the first and second slideable members such that when the actuator is in the unlocked position the first and second slideable members are moveable within the first channel and the first slideable member is moveable relative to the second slideable member within the second channel.

Embodiments of the armrest can also include an arm pad connected to the first slideable member and an adjustment member attached to the first slideable member between the actuator and the first slideable member. The adjustment member may be attached to the first slideable member such that the adjustment member is moveable relative to the first slideable member when the actuator is moved from the locked position to the unlocked position and is also moveable relative to the first slideable member when the actuator is moved from the unlocked position to the locked position. The actuator can have a first end and a second end opposite the first end. The second end of the actuator may have a connector extending therefrom. The adjustment member can have an upper aperture sized to receive the connector of the actuator for attaching the actuator to the adjustment member. A spring member can be attached to the actuator to bias the actuator to the locked position. In some embodiments, the actuator can have a plurality of protuberances comprising a first protuberance adjacent a first side of the connector of the actuator and a second protuberance adjacent a second side of the connector of the actuator that is opposite the first side. The spring member can have a first projection spaced apart from a second projection to define an opening between the first and second projections. The first projection may be attached to the actuator adjacent to the first protuberance and the second projection can be attached to the actuator adjacent to the second protuberance for biasing the actuator to the locked position. The connector of the actuator can extend downwardly from the actuator and through the opening defined between the first and second projections of the spring member.

Some embodiments of the armrest can include an interlocking member having a first connecting portion adjacent a first side of the interlocking member and having a second connecting portion adjacent a second side of the interlocking member that is opposite the first side of the interlocking member. The first connecting portion can be rotatably positioned within an aperture defined in the first slideable member and the second connecting portion can pass through a slot defined in a lower portion of the adjustment member and an arcuate slot defined in a lower portion of the first slideable member such that that the second connecting portion is rotatable about the first connecting portion when the actuator is moved from the locked position to the unlocked position. The second connecting portion can be moveable within the arcuate slot defined in the lower portion of the first slideable member and the slot defined in the lower portion of the adjustment member when the actuator is moved from the locked position to the unlocked position. The second slideable member can have an opening in communication with the second channel and there can be a rack attached to the post. The first and second slideable members can be moveable relative to the rack for adjusting a position of the arm pad from an uppermost position to a lowermost position when the actuator is moved to the unlocked position.

Some embodiments of the armrest may also include an engagement member attached to the second slideable member on a side of the second slideable member that is opposite a side of the second slideable member in which the opening of the second slideable member is defined. The rack can have a first side having steps and a second side opposite the first side of the rack that at least partially defines an aperture and the engagement member can be attached to the second slideable member such that the engagement member is moveable within the aperture at least partially defined in the second side of the rack. The engagement member can be moveable vertically relative to the rack from a lowermost position adjacent a bottom portion of the rack to an uppermost position in which the engagement member engages an upper portion of the second side of the rack or a blocking member attached to an upper portion of the second side of the rack adjacent the aperture of the second side of the rack. The interlocking member can be rotated from a first position in which a portion of the interlocking member engages a first step of the steps of the rack to a second position in which the interlocking member is released from the first step such that the first and second slideable members are moveable relative to the rack when the actuator is moved from the locked position to the unlocked position.

In some embodiments, the second slideable member can be moveable after the first slideable member is moved upwards vertically from a lower position relative to the rack when the actuator is in the unlocked position such that a portion of the interlocking member engages the second slideable member adjacent a top of the opening of the second slideable member. The second slideable member may be moveable when the portion of the interlocking member engages the portion of the second slideable member adjacent the top of the opening of the second slideable member such that both the first and second slideable members are moved upwards relative to the rack when the second slideable member moves upwardly.

Some embodiments of the armrest for a chair can include: a support post sized and configured for attachment to a chair where the post has a first inner channel, a first slideable member moveably positioned within the first channel, an arm pad connected to the first slideable member, and a second slideable member moveably positioned within the first channel where the second slideable member has a second channel. The first slideable member can be moveably positioned within the second channel such that the first slideable member is moveable relative to the second slideable member. An interlocking member having a first connecting portion adjacent a first side of the interlocking member and having a second connecting portion adjacent a second side of the interlocking member that is opposite the first side of the interlocking member can also be included. The first connecting portion can be rotatably positioned within an aperture defined in the first slideable member. The second connecting portion can pass through an arcuate slot defined in a lower portion of the first slideable member such that that the second connecting portion is rotatable about the first connecting portion. The second connecting portion can be moveable within the arcuate slot defined in the lower portion of the first slideable member to facilitate height adjustment of the arm pad. In some embodiments an adjustment member can also be provided such that the second connecting portion of the interlocking member extends through a slot of the adjustment member to connect the first slideable member to the adjustment member.

The armrest can be configured so that the second slideable member can have an opening in communication with the second channel. A rack can be attached to the post. The first and second slideable members can be moveable relative to the rack for adjusting a position of the arm pad from an uppermost position to a lowermost position when the actuator is moved to the unlocked position. An engagement member can be attached to the second slideable member on a side of the second slideable member that is opposite a side of the second slideable member in which the opening of the second slideable member is defined. The rack can have a first side having steps and a second side opposite the first side of the rack that at least partially defines an aperture. The engagement member can be attached to the second slideable member such that the engagement member is moveable within the aperture at least partially defined in the second side of the rack. The engagement member can also be moveable vertically relative to the rack from a lowermost position adjacent a bottom portion of the rack to an uppermost position in which the engagement member engages an upper portion of the second side of the rack or a blocking member attached to an upper portion of the second side of the rack adjacent the aperture of the second side of the rack.

A chair is also provided. The chair may include an embodiment of the armrest. In some embodiments, the chair can include a base, at least one of a backrest supported by the base and a seat supported by the base, and a first armrest attached to at least one of the base, the seat, and the backrest. The first armrest can be an embodiment of the armrest.

For example, the first armrest can include a support post attached to at least one of the base, the seat, and the backrest, the support post having a first channel, a first slideable member positionable in the first channel that is moveable within the first channel; and a second slideable member moveably positioned in the first channel. The second slideable member can have a second channel. The first slideable member can be moveably positioned in the second channel such that the first slideable member is moveable relative to the second slideable member within the second channel from a retracted position to an extended position. An arm pad can be attached to the first slideable member. The arm pad can be moveable from a lowermost position to an uppermost position.

An actuator that is moveable from a locked position to an unlocked position can also be included in the chair. The actuator can be connected to the first and second slideable members such that:

- when the actuator is in the locked position the first and second slideable members being prevented from moving vertically within the first channel, and
- when the actuator is in the unlocked position, the first and second slideable members being moveable vertically within the first channel such that the first and second members are extendable out of the first channel to adjust the arm pad to the uppermost position of the arm pad and retractable into the first channel to adjust the arm pad to the lowermost position of the arm pad when the actuator is in the unlocked position.

In some embodiments of the chair, the first armrest can also include an adjustment member attached to the first slideable member between an actuator and the first slideable member. The adjustment member can be attached to the first slideable member such that the adjustment member is moveable relative to the first slideable member when the actuator is moved from the locked position to the unlocked position and is also moveable relative to the first slideable member when the actuator is moved from the unlocked position to the locked position.

The actuator can have a first end and a second end opposite the first end. The second end of the actuator can have a connector extending therefrom and the adjustment member can have an upper aperture sized to receive the connector of the actuator for attaching the actuator to the adjustment member. The first armrest can also include at least one spring member attached to the actuator to bias the actuator to the locked position.

In some embodiments of the chair, the first armrest can also include an interlocking member having a first connecting portion adjacent a first side of the interlocking member and having a second connecting portion adjacent a second side of the interlocking member that is opposite the first side of the interlocking member. The first connecting portion can be rotatably positioned within an aperture defined in the first slideable member. The second connecting portion can pass through a slot defined in a lower portion of the adjustment member and an arcuate slot defined in a lower portion of the first slideable member such that that the second connecting portion is rotatable about the first connecting portion when the actuator is moved from the locked position to the unlocked position. The second connecting portion can also be moveable within the arcuate slot defined in the lower portion of the first slideable member and the slot defined in the lower portion of the adjustment member when the actuator is moved from the locked position to the unlocked position.

Embodiments of the chair can be configured so that the first armrest also includes a rack attached to the post within the first channel. The first and second slideable members can be moveable relative to the rack for adjusting a position of the arm pad from between the uppermost position and the lowermost position of the arm pad when the actuator is moved to the unlocked position. The rack can have a first side having steps attached thereto or formed thereon and a second side opposite the first side that at least partially defines an aperture. An engagement member can be attached to the second slideable member on a side of the second slideable member that is opposite a side of the second slideable member in which the opening of the second slideable member is defined such that the engagement member is moveable adjacent the rack within the aperture. The engagement member can be moveable vertically relative to the rack from a lowermost position adjacent a bottom portion of the rack to an uppermost position in which the engagement member engages an upper portion of the first side of the rack or a blocking member attached adjacent the upper portion of the first side of the rack. The interlocking member can be rotated from a first position in which a portion of the interlocking member engages a first step of the steps of the rack to a second position in which the interlocking member is released from the first step such that the first and second slideable members are moveable relative to the rack when the actuator is moved from the locked position to the unlocked position. Some embodiments of the chair can be configured so that the second slideable member is moveable after the first slideable member is moved upwards vertically from a lower position relative to the rack when the actuator is in the unlocked position such that a portion of the interlocking member engages the second slideable member adjacent at a top of the opening of the second slideable member. The second slideable member can be moveable when the portion of the interlocking member engages the portion of the second slideable member adjacent the top of the opening of the second slideable member such that both the first and second slideable members are moved upwards relative to the rack when the second member moves upwardly. The upper portion of the first side of the rack or the blocking member attached adjacent the upper portion of the first side of the rack engages the engagement member to define the uppermost position of the arm pad.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of an armrest for a chair and a chair having armrests are shown in the accompanying drawings and certain exemplary methods of practicing the same are also illustrated therein. It should be appreciated that like reference numbers used in the drawings may identify like components.

DETAILED DESCRIPTION OF EXEMPLARY EMBODIMENTS

Figure 1:
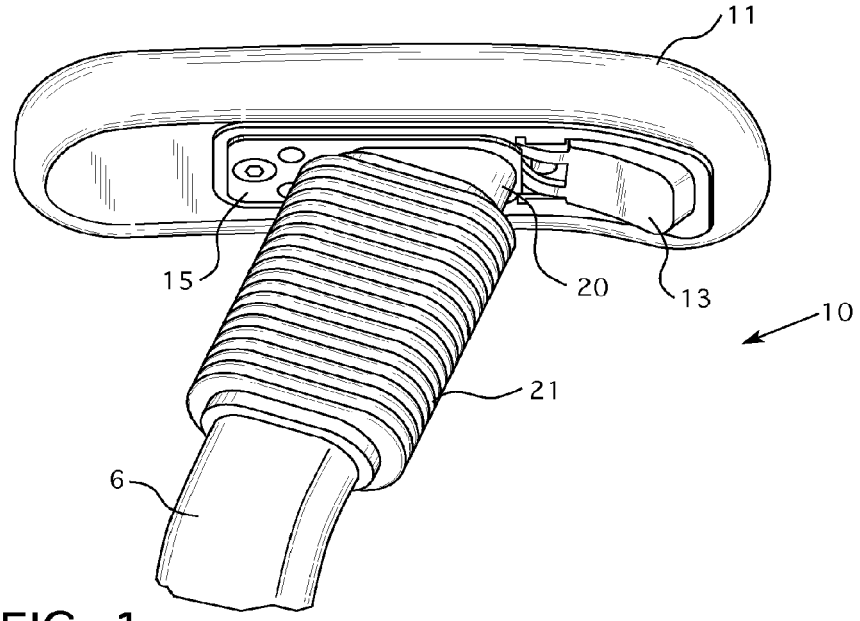
FIG. 1 is a bottom perspective view of a first exemplary embodiment of an armrest for a chair in a first vertical position.
Figure 2:
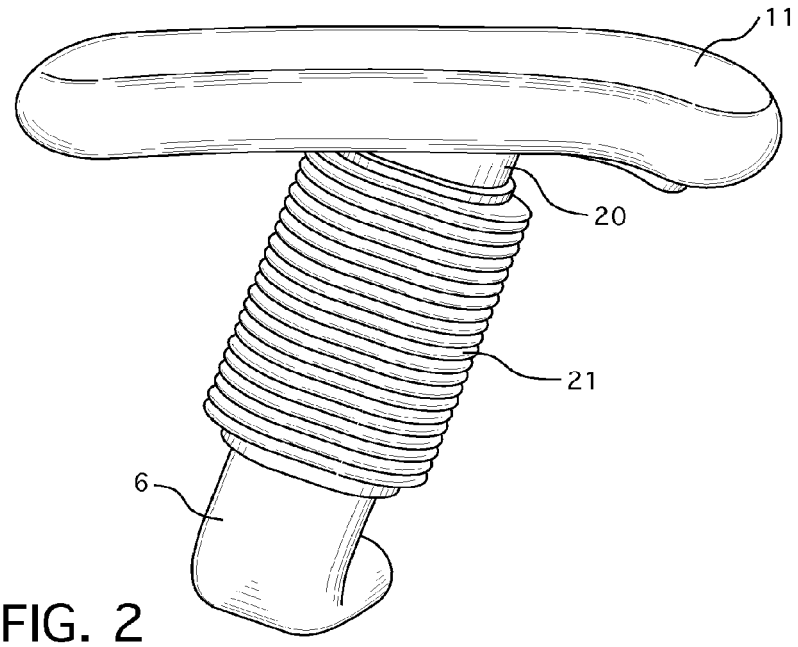
FIG. 2 is a perspective view of the first exemplary embodiment of the armrest for a chair with the arm pad of the armrest in a first vertical position.
Figure 3:
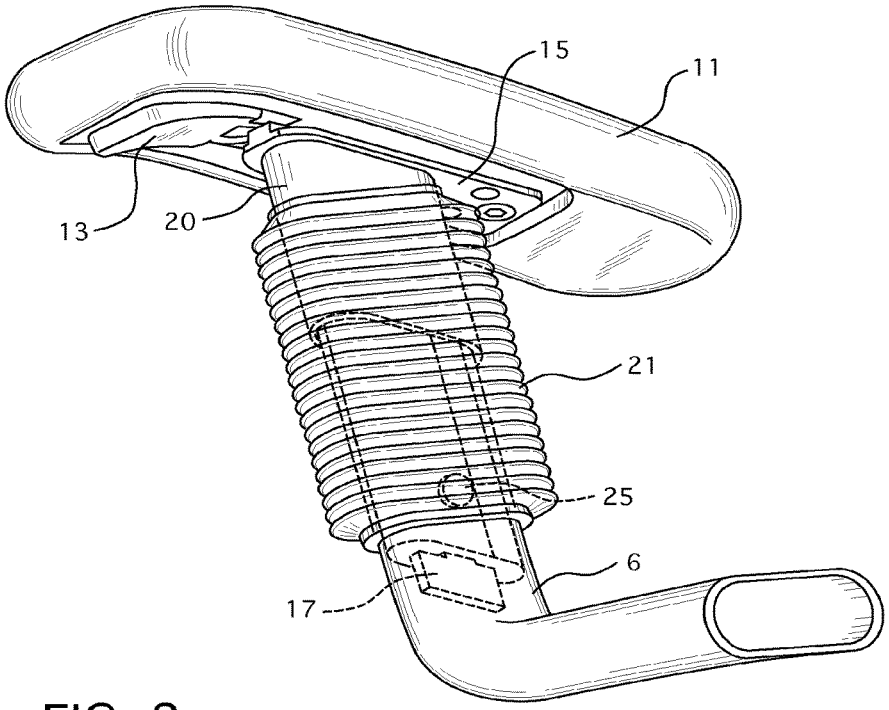
FIG. 3 is a perspective view of the first exemplary embodiment of the armrest with the arm pad of the armrest in the first vertical position with a portion of an expandable outer housing cut away to illustrate inner components of the armrest.
Figure 4:
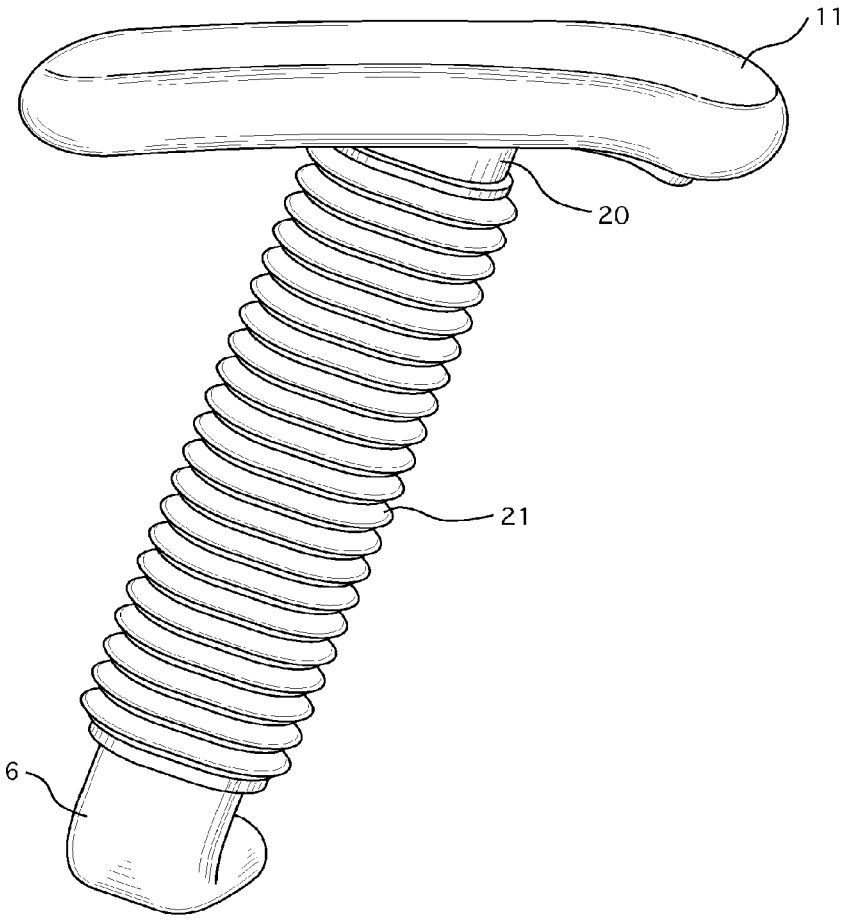
FIG. 4 is a perspective view of the first exemplary embodiment of the armrest for a chair with the arm pad in a second vertical position that is more elevated than the first vertical position. First and second slideable members are extended out of a support post when the arm pad is in the second vertical position.
Figure 5:
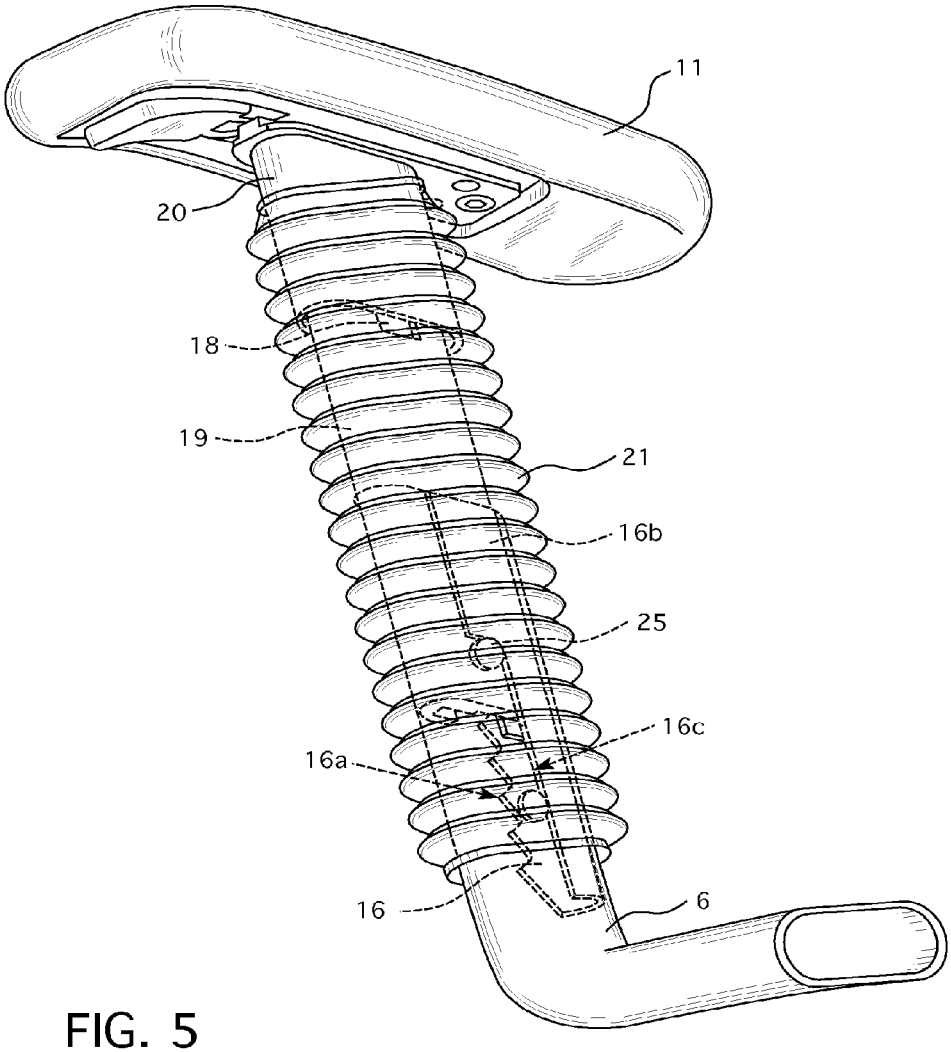
FIG. 5 is a perspective view of the first exemplary embodiment of the armrest with the arm pad in the second vertical position with a portion of the expandable outer housing cut away to illustrate inner components of the armrest.
Figure 6:
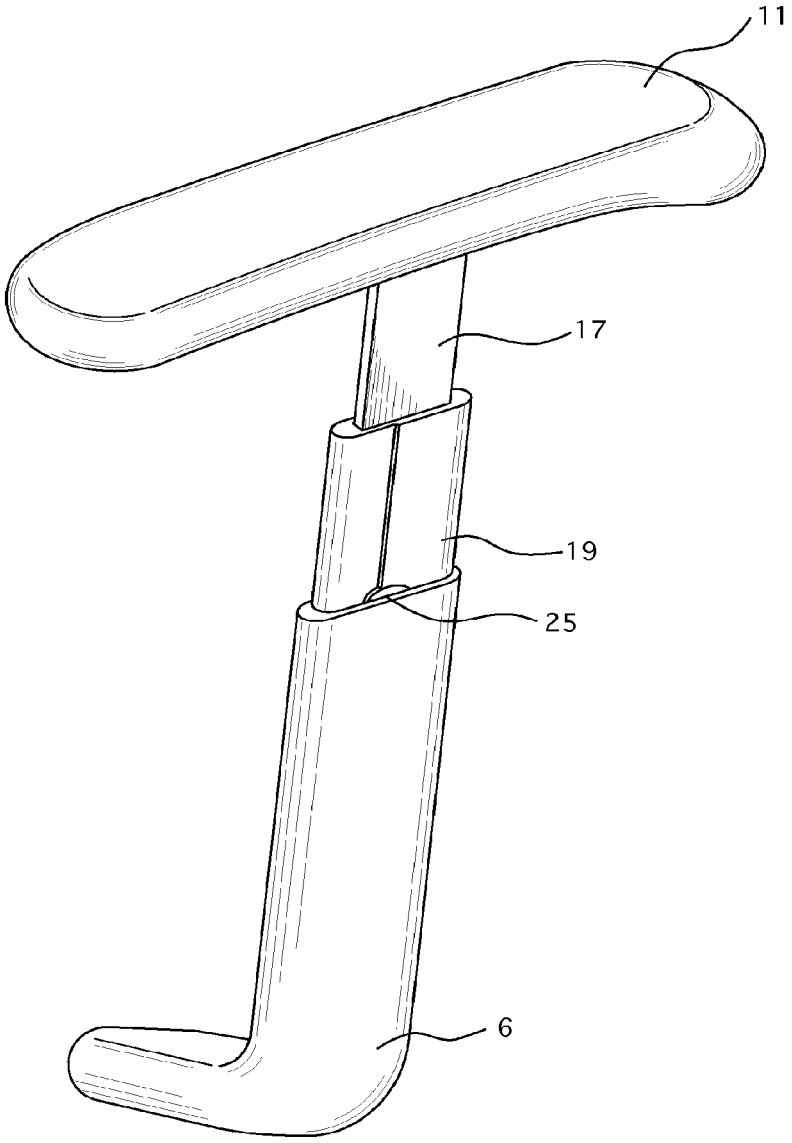
FIG. 6 is a perspective view of the first exemplary embodiment of the armrest with portions of the armrest cut way to illustrate inner components of the armrest.
Figure 7:
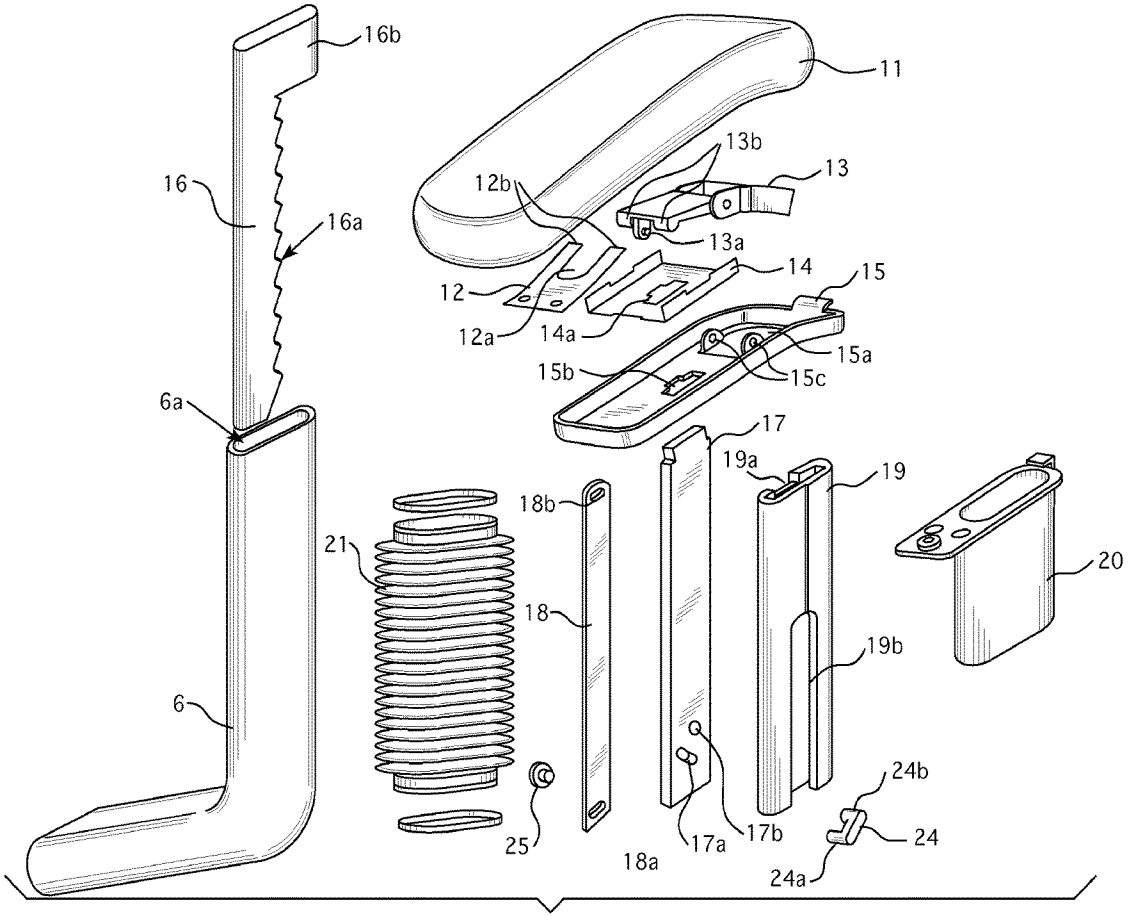
FIG. 7 is an exploded view of the first exemplary embodiment of the armrest.
Figure 8:
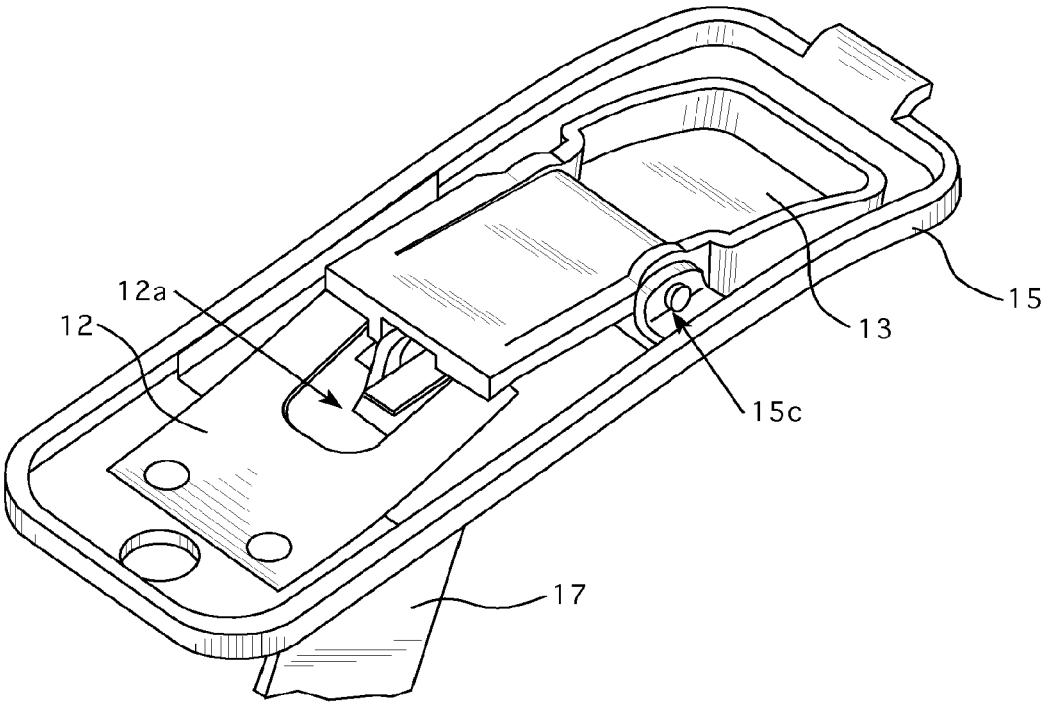
FIG. 8 is a top fragmentary view of the first exemplary embodiment of the armrest with the arm pad cut away to illustrate elements of an exemplary height adjustment actuation mechanism included in the armrest.
Figure 9:
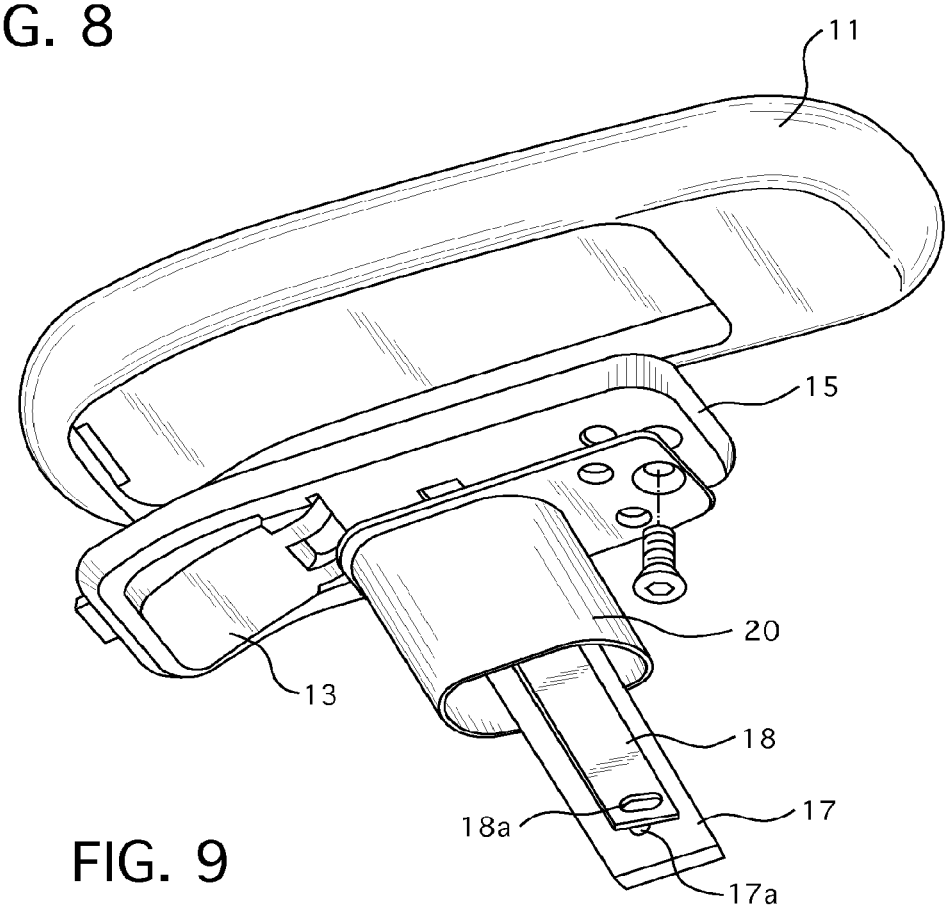
FIG. 9 is a fragmentary exploded view of the first exemplary embodiment of the armrest.
Figure 10:
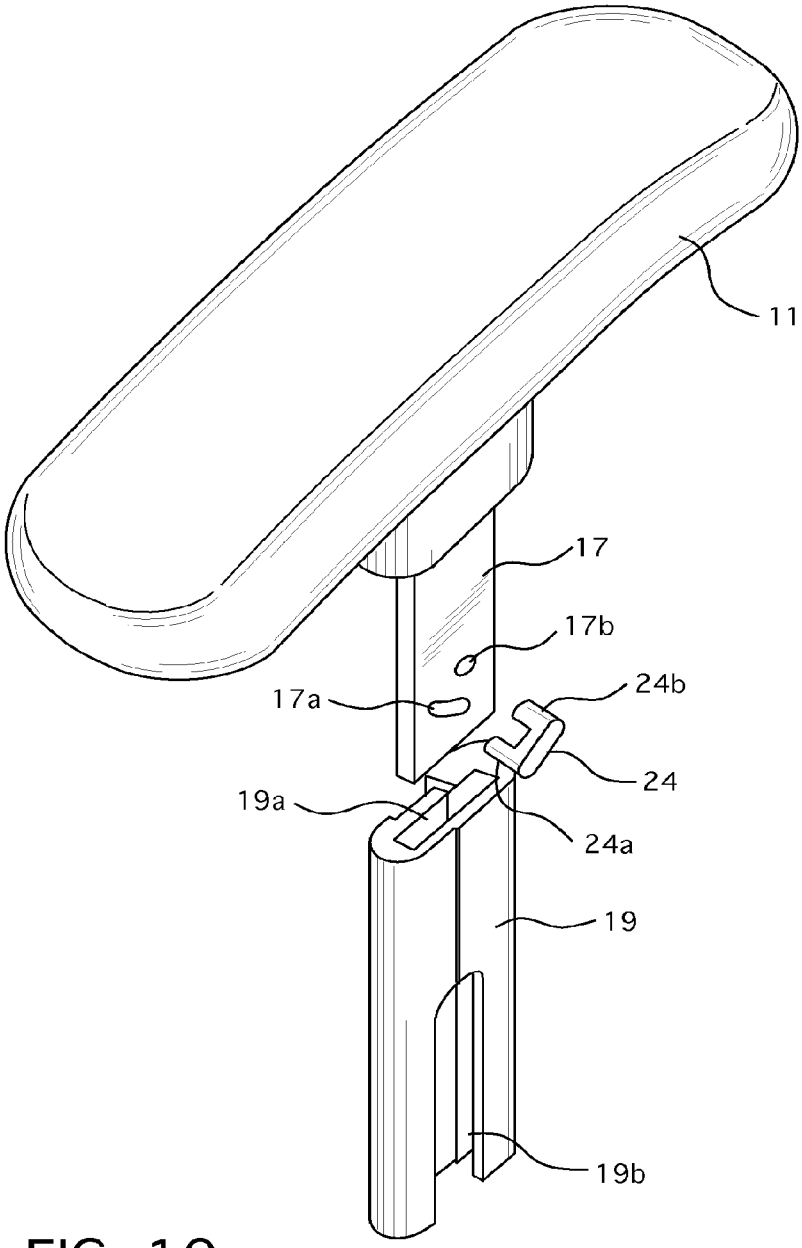
FIG. 10 is a top fragmentary exploded view of the first exemplary embodiment of the armrest.
Figure 11:
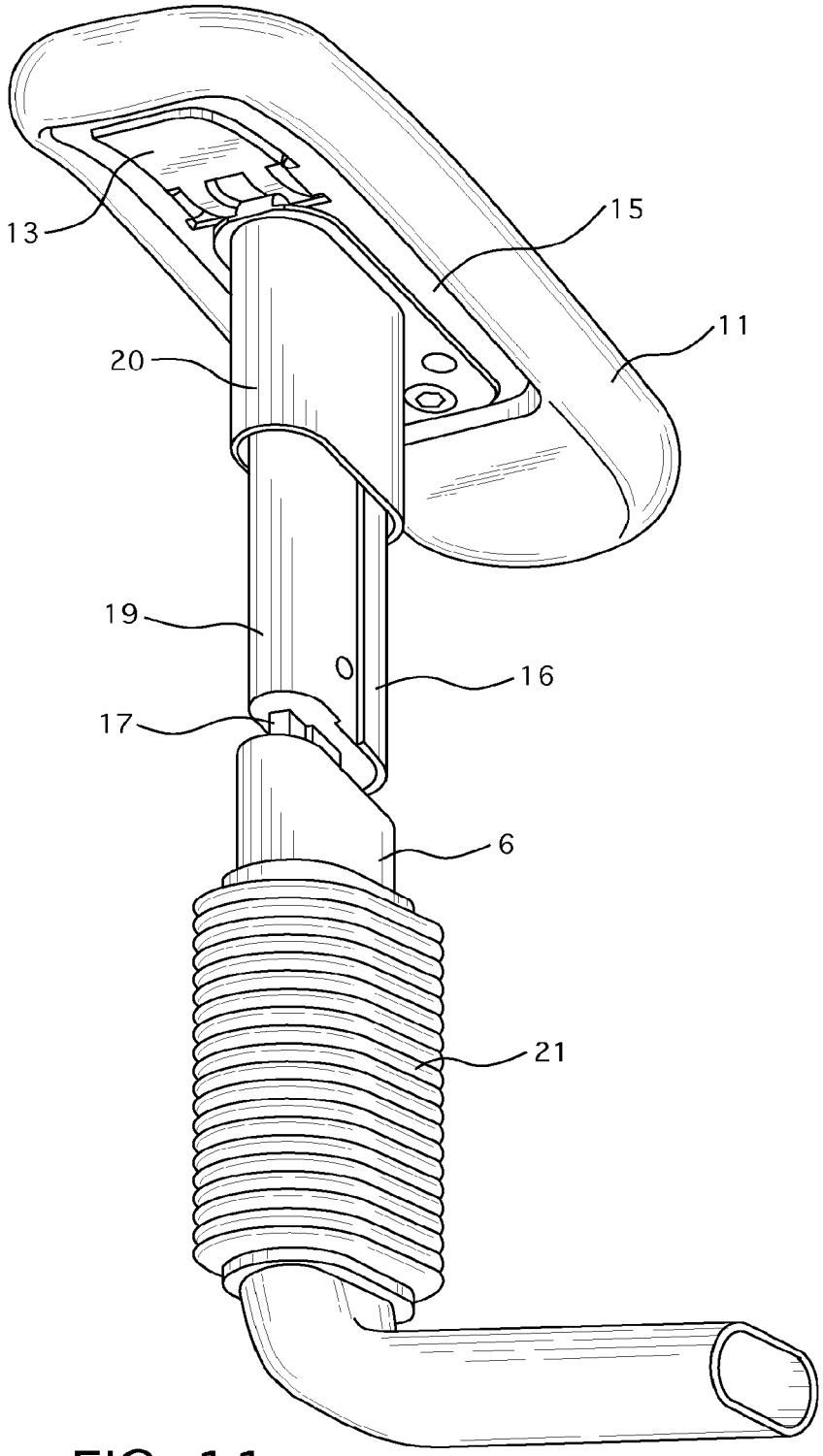
FIG. 11 is a fragmentary exploded view of the first exemplary embodiment of the armrest being attached to a support post that can couple the armrest to the base of a chair or the seat assembly of a chair.
Figure 12:
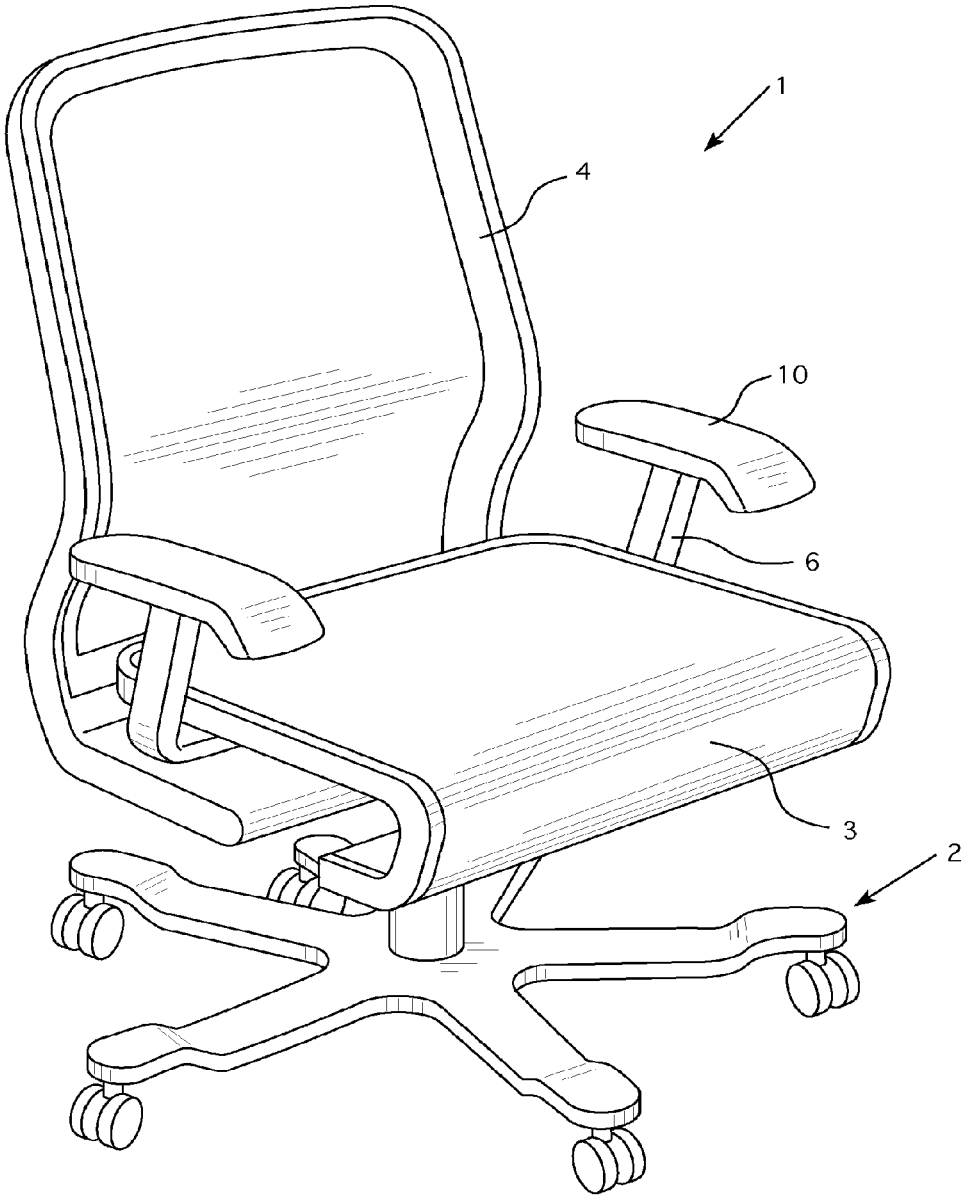
FIG. 12 is a perspective view of a chair having the first exemplary embodiment of armrests attached thereto.

Referring to FIGS. 1-12, a chair 1 can include a base 2 that supports a seat 3 and a backrest 4. The seat 3 and backrest 4 may each be moveable from an upright position to a reclined position via a tilt mechanism connected between the base and at least one of the seat and the backrest. The seat may include a seat frame and a seat skin attached to the seat frame. A pad or cushion may be supported by the seat frame and be covered by the seat skin. The backrest 4 can include a backrest frame that is attached to a back skin. A cushion may be positioned so that the back skin covers at least a portion of the cushion.

The seat 3 may include a seat slide that is attached to a seat frame to permit the seat to slide forwardly and rearwardly relative to the backrest. The seat frame may be directly attached to the base 2. The backrest may be directly attached to the seat 3, the base 2 or both the seat 3 and the base 2. The frame of the backrest 4 may include a lower portion that is attached to a tilt mechanism coupled to the base or the seat frame, for example.

Only the seat 3, only the backrest 4, or both the seat and backrest may be pivotally coupled to the base or may be resiliently coupled to the base 2 for movement relative to the base so that the seat 3 and backrest 4 are moveable from an upright position to a reclined position. The seat and backrest may also be pivotally coupled to each other or may be resiliently coupled to each other such that the seat and backrest are moveable synchronously from an upright position to a reclined position and vice versa. The seat 3 may additionally be moveable relative to the backrest 4 independent of the backrest 4 via a seat slide or other mechanism. The backrest 4 may also be configured to be moveable relative to the seat 3 independent of the seat 3.

The base 2 of the chair may be a pedestal base that includes castors. A gas spring may be included in the base. The gas spring can be actuatable to adjust a height of the seat 3 and backrest 4. Alternatively, the base of the chair can include a non-height adjustable post or a plurality of legs that are attached to the seat 3 or frame of the seat 3 to support the seat 3 on a floor.

Armrests 10 can be attached to the chair 1. The armrests 10 can be attached on opposite sides of the seat 3 or be attached to the base 2 such that arm pads 11 are positioned above the seat 3 adjacent opposite sides of the seat 3. Alternatively, the armrests 10 can be attached to a frame of the backrest 4. Posts 6 or other members may connect the armrests 10 to the base 2 of the chair, the seat frame of the chair, the seat of the chair, the backrest frame of the chair, or the backrest of the chair. The arm pads 11 of the armrest can be moveable to different vertical positions. It is also contemplated that the arm pads 11 can be configured for movement horizontally for slidable or rotatable motion of the arm pad. Each armrest may include a mechanism that can be attached to the arm pad to lock the position of the arm pad that is also adjustable to an unlocked position for permitting sliding movement of the arm pad to another position. The mechanism can alternatively be configured to have only one setting that is always on such that the horizontal position of the arm pad 11 is controlled by friction such that a user must provide a manual force that overcomes friction to slide the arm pad 11, rotate, and/or otherwise move the arm pad 11 to any one of a plurality of different positions.

Each armrest 10 can include a plurality of components interconnected between the support post 6 and the arm pad 11 to permit the height of the arm pad 11 to be adjusted to any of a plurality of different vertical positions. A lock mechanism or actuation mechanism can be moved from a lock position to an unlock position to permit vertical adjustment of the arm pad 11 and also permit the vertical position of the arm pad 11 to be locked in place or maintained in place. The lock mechanism or actuation mechanism can be moved to the unlock position to permit the height of the arm pad 11 to be adjusted to a new position by a user providing an upward force on the arm pad 11 to raise the position of the arm pad 11 or controlling the downward motion of the arm pad 11 by providing a force on the arm pad to control how the arm pad 11 may drop in height due to gravity causing different components to allow the arm pad 11 to drop to a new lower position when the lock mechanism or actuation mechanism is moved to the unlocked position. When in that new position, the lock mechanism or the actuation mechanism can be moved to the locked position so that the arm pad 11 is not moveable to another vertical position unless the lock mechanism or actuation mechanism is subsequently returned to the unlocked position.

Embodiments of the height adjustment mechanism that can be included in each armrest 10 can include a set of slidable members that can each move to be extendable and retractable from the support post 6 to provide vertical height adjustment of the arm pad 11. The group of interconnected components of the height adjustment mechanism can also include a rack 16 that is immovably affixed to the support post 6 within a central channel of the support post 6. The rack can include a plurality of steps that define a linear path of vertical travel for the arm pad 11 from a lowermost position to an uppermost position and also define positions between the lowermost and uppermost positions. The steps may be structured as teeth or other type of projection or protuberance that defines different positions for the arm pad as first and second slideable members 17 and 19 may move along those steps and be selectively positioned via use of any one of the steps defining the linear path of travel.

A second slideable member 19 may be positioned for sliding motion within a first path along the rack 16 after a first slideable member 17 has been moved relative to the rack 16 along a first portion of the vertical path of travel defined by the rack 16. When moving along this first portion of the vertical path of travel defined by the rack 16, the first slideable member 17 can also move relative to the second slideable member 19 such that the first slideable member 17 moves vertically but the second slideable member stays in its same position and/or moves at a different extent of travel than the first slideable member 17. The second slideable member 19 can be configured such that upward movement of the second slideable member along a second portion of the vertical path defined by the rack 16 that may be located above the first portion of travel can also result in the first slideable member 17 moving with the second slideable member 19.

A first slideable member 17 can be slideably positioned within a central channel 19*a* of the second slideable member 19. The first slideable member 17 can be partially slid out of the central opening 19*a* of the second slideable member to provide height extension of the arm pad 11. After the first slideable member 17 is moved to its furthest extent out of the central channel 19*a*, the first slideable member 17 may engage the second slideable member 19 such that further upward force acting on the first slideable member 17 causes the second slideable member 19 to move from adjacent a lowermost position within the support post adjacent the rack 16 to an uppermost position within the support post adjacent rack 16. A portion of the rack 16 can be configured as a blocking member 16*b* or the blocking member 16*b* can be otherwise attached to the rack 16 to contact with or otherwise engage an engagement member 25 attached to the second slideable member 19 to define the uppermost position of the second slideable member 19.

The first and second slideable members 17 and 19 may slide vertically out of and into the post for extending and retracting from the post 6. The motion of the slideable members may be perfectly vertical or may be along a linear inclined path or a linear declined path such that the vertical motion of the first and second slideable members 17 and 19 each also includes a horizontal component of motion. It is also contemplated that some embodiments could be configured such that the first and second slideable members 17 and 19 are curved and move vertically along an arcuate path or a curved path.

The arm pad 11 may be connected to the second slideable member 17 via an elongated adjustment member 18 to permit actuation of the height adjustment of the arm pad 11 by sliding the first and second slideable members 17 and 19 out of the post 6 for upwardly extending the position of the arm pad 11. The adjustment member 18 may also be actuated to permit a sliding motion of the first and second slideable members 17 and 19 so that these members retract back into the support post 6 such that the arm pad 11 can be moved to a vertically lower position. To lower the arm pad 11, the adjustment member 18 may be moved so that the second slideable member 19 may slide down or otherwise move downward within the channel 6*a* relative to the rack 16 to a lowermost position within the support post 6. Once the second slideable member 19 reaches its lowermost position within the support post 6, the first slideable member 17 may then be moveable from its uppermost position within a central channel 19*a* of the second slideable member 19 to its lowermost position within the central channel 19*a* such that the first slideable member 17 is moved to its lowermost position within the post 6.

In some embodiments, the second slideable member 19 may move downward to its lowermost position within post 6 prior to the first slideable member 17 moving downward. In other embodiments it is contemplated that the first and second slideaable members may both be configured to move downwardly at the same time from their respective uppermost positions, or most extended positions, out of the post 6, to their lowermost positions, or most retracted positions, within the post 6. For instance, the actuation of the adjustment member 18 to release the locking of the positions of the first and second slideable members 17 and 19 could be configured to permit both members to slide downwardly due to gravity at the same time.

Actuation of the height adjustment mechanism that permits vertical positioning of the arm pad 11 can be configured in numerous different ways. In some embodiments, the height adjustment mechanism of each armrest 10 can include an arm pad 11 that is attached to an arm pad support member 15. The arm pad 11 can include an opening formed in its bottom portion that is sized to receive a moveable actuator 13 and a spring member 12 that is configured to bias the actuator 13 to a locked position. The spring member may be a resilient member such as a leaf spring structure, an elastomeric member, or other spring element or resilient member that can bias the actuator 13 to its locked position. A user may be required to use a hand or one or more fingers to press the actuator 13 to act against the force of the spring member 12 biasing the actuator 13 to the locked position to unlock the height adjustment mechanism and permit height adjustment of the arm pad 11.

A connection member 14 can be configured for attaching the spring member 12 to the actuator 13 together as well as attaching the actuator 13 and spring member 12 to the arm pad support member 15. The connection member 14 can be sized to help affix the spring member 12 and actuator to the arm pad support member 15 within the opening formed in the bottom portion of the arm pad 11. The connection member 14 can additionally or alternatively be configured to reduce wear that could be experienced by the arm pad support member 15 by being positioned between an internal surface of the arm pad support member and the spring member 12 and actuator 13 so that motion of the spring member 12 and actuator 13 can result in those elements contacting the connection member 14 instead of the surface of the arm pad support member 15.

The actuator 13 can include a first end that is sized for extending out of an opening 15*a* formed in the arm pad support member 15 so that a portion of the actuator 13 can be contacted by a user to move the actuator 13 to actuate height adjustment. The actuator 13 may also have a second end opposite its first end that has protuberances 13*b* sized to be pivotally attached to the arm pad support member 15. Each protuberance 13*b* may have an end that is received within a hole 15*c* of the arm pad support member so that the actuator is pivotable about the ends of the protuberances 13*b*.

Projections 12*b* of the spring member 12 can also be attached to the actuator 13 adjacent the protuberances 13*b*. The projections 12*b* can be spaced apart from one another by an aperture 12*a* defined by the spaced apart projections 12*b* and intermediate portion of the spring member from which those projections 12*b* extend. The aperture 12*a* is sized so that a space is provided between the projections 12*b* so that a centrally located downwardly extending connector 13*a* can extend from the second end of the actuator 13 and pass through the aperture 12*a* of the spring member 12, aperture 14*a* defined in the connection member 14 and aperture 15*b* defined in the arm pad support member 15 for connecting to the adjustment member 18.

The downwardly extending connector 13*a* can be sized to be matingly interconnected to the adjustment member 18 by passing through an opening 18*b* formed in the upper end of the adjustment member 18. The connector 13*a* can be attachable to the adjustment member 18 such that pivotal motion of the actuator 13 results in the adjustment member 18 being rotated.

The portion of the actuator 13 that extends out of opening 15*a* can be pressed by a user so that the first end of the actuator is moved upwardly into the arm pad support member 15 toward the arm pad 11. The second end of the actuator 13 will rotate downwardly in response to the upward motion of the first end of the actuator 13. The downward motion of the second end of the actuator 13 can drive rotation of the adjustment member 18 attached to the connector 13*a* from its first, locked position, to a second, unlocked position. When the user removes the force from the actuator, the spring member 12 can provide a force that acts on the actuator 13 to drive the first end of the actuator to extend further out of the opening 15*a* downwardly while also driving the second end of the actuator and the connector 13*a* upwardly to rotate the adjustment member 18 back to its locked position, or first position.

The adjustment member 18 is attached to the first slidable member 17 that is slidably attached to the second slidable member 19 and is moveable within a central channel 6*a* of the support post 6. The second slidable member 19 is moveably positioned within the central channel 6*a* formed in the support post 6. The upper end of the adjustment member 18 is attached to the actuator 13 via upper opening 18*b* receiving the connector 13*a* for interlocking with the connector 13*a*. The lower end of the adjustment member 18 has an elongated slot 18*a* that is elongated linearly and is sized to moveably receive a portion of an interlocking member 24 for attaching the adjustment member 18 to the first slidable member 17 and second slidable member 19. The elongated slot 18*a* can be a horizontal slot or can be a slot that is angled so that the slot extends along a declined or inclined linear path that may have rounded ends where one end is at a more elevated position on the adjustment member 18 than the opposite end of the slot 18*a*. The slot 18*a* can be defined within the adjustment member 18 as an elongated opening such that the slot 18*a* can be an elongated rectangular shaped, polygonal shaped, or oval shaped aperture.

The interlocking member 24 has a first connecting portion 24*b* that is on a first side of the interlocking member 24 that is opposite a second side of the interlocking member 24 to which a second connecting portion 24*a* extends. The first connecting portion 24*b* is sized to pass through a generally circular or polygonal shaped opening 17*b* in the first slidable member 17 that is sized to rotatably receive the first connecting portion 24*b* of the interlocking member.

The second connecting portion 24*a* of the interlocking member 24 passes through an arcuate slot 17*a* that is formed in the first slidable member 17. The arcuate slot 17*a* is formed such that the slot 17*a* is elongated at an angle such that the slot 17*a* extends both vertically and horizontally from a lower end to an upper end. The slot 17*a* defines a curved path of travel for a portion of the second connecting portion 24*a*. The second connecting portion 24*a* passes through the slot 17*a* as well as the slot 18*b* of the adjustment member 18 for interconnecting the adjustment member 18 to the first slidable member 17.

The adjustment member 18 is positioned on a first face of the first slideable member 17. The first slideable member 17 is positioned within the central channel 19*a* defined within the second slideable member 19. An intermediate portion 24*c* of the interlocking member 24 that is between the first and second connecting portions 24*b* and 24*a* is positioned within the opening 19*b* defined in the second slideable member 19*b* that is in communication with the central channel 19*a* for movement within the opening 19*b* as well as movement into and out of contact with and/or engagement with the steps 16*a* (e.g. teeth, spaced apart projections, etc.) on a side of the rack 16.

The opening 19*b* of the second slideable member 19 is sized to receive steps 16*a* of the rack 16 that are on or otherwise attached to a first side of the rack 16 so that at least some of the steps 16*a* are extendable within the opening 19*b* for receiving and releaseably retaining the interlocking member 24 (e.g. the intermediate portion 24*c* of the interlocking member 24).

When the armrest 10 is assembled and attached to the support post 6, the rack 16 can be immovably positioned in the channel 6*a* of the support post 6 and can be configured to have steps 16*a* that are sized to extend into the second opening 19*b* of the second slideable member 19 for releaseably receiving the intermediate portion 24*c* of the interlocking member that is configured to releaseable interlock with those steps (e.g. spaced apart linearly aligned teeth, projections, protuberances, etc.) 16*a* for positioning of the arm pad 11 at different height positions. The interlocking member 24 may be moved relative to the second slideable member 19 and the steps 16*a* of the rack 16 to adjust the vertical position of the arm pad 11. The interlocking member 24 can be moved out of engagement with a lower step to a higher position for engagement with an upper step of the rack 16.

When the interlocking member 24 is moved to be positioned in an upper step, the first slideable member 17 may also be moved relative to the second slideable member 19 to further extend out of the post 6 to provide further height adjustment of the pad 11. The first slideable member 17 may be slid relative to the second slideable member 19 within the central channel 19*a* adjacent to the opening 19*b* of the second slideable member 19 that is in communication with the central channel 19*a* while the position of the interlocking member is moved from one step of the rack to another upper step of the rack.

The upper end of the opening 19*b* can be defined by a portion of the second slideable member 19 and can also define the uppermost position of the first slideable member 17 within the channel 19*a* of the second slideable member 19 at which the greatest extent of the first slideable member 17 is extended out of the channel 19*a* of the second slideable member 19. A portion of the second slideable member 19 that defines the bottom of the central channel 19*a* can define the lowermost position of the first slideable member 17 within the central channel 19*a*, which can be a position in which the first slideable member 17 is fully retracted within the second slideable member 19 or is the least extended out of the channel 19*a* of the second slideable member 19.

Movement of the actuator 13 can be configured to move the adjustment member 18 and rotate the interlocking member 24 to permit vertical sliding motion of both the first and second slideable members 17 and 19. For instance, when a user pushes or presses the first end portion of the actuator 13 upwardly into the arm pad support member 15 toward the arm pad 11, the second end of the actuator 13 moves downwardly from a locked position to an unlocked position. The adjustment member 18 attached to the second end of the actuator 13 via connector 13*a* is also moved downwardly due to the downward motion of the second end of the actuator 13. This downward motion of the adjustment member 18 is translated to the second connecting portion 24*a* of the interlocking member 24 by the portion of the adjustment member 18 that defines the slot 18*a* in which the second connecting portion 24*a* passes through. The downward motion of the second connecting portion 24*a* causes the interlocking member 24 to rotate about the first connecting portion 24*b* that is positioned within the generally circular or polygonal shaped opening 17*b*. The rotation of the interlocking member 24 about the first connecting portion 24*b* causes the intermediate portion 24*c* of the interlocking member 24 to move out of contact with the step of the rack 16 or out of engagement with the step of the rack 16 to which that portion 24*c* was previously engaged so that the first and second slideable members 17 and 19 are vertically moveable within the post 6 relative to the steps 16*a* of the rack 16 positioned within the post 6.

After moving the actuator 13 to the unlocked position and maintaining the actuator 13 in the unlocked position, a user may pull up on the arm pad 11 to drive upward motion of the first and second slideable member 17 and 19 from a bottommost position of the arm pad 11 to an uppermost position of the arm pad 11. The first slideable member 17 may move vertically first relative to the second slideable member 19 within central channel 19*a* until the second connecting portion 24*a* of the interlocking member 24 is slid from its bottommost position within the central channel 19*a* and opening 19*b* to its uppermost position within the central channel 19*a* and opening 19*b*. When in the uppermost position within the central channel 19*a*, the intermediate portion 24*c* of the interlocking member 24 is in contact with or otherwise engages the portion of the second slideable member 19 that defines the top of the opening 19*b*. At this position, the interlocking member 24 may be prevented from further upward motion along the second slideable member 19.

Thereafter, the upward force the user is applying to the arm pad 11 to move the arm pad 11 to a higher position is translated to the second slideable member 19 so that the second slideable member 19 along with the first slideable member 17 may move within the post 6 to an uppermost position adjacent the rack 16. The first slideable member 17 also moves with the second slideable member 19 due to the connection the second slideable member 19 has with the first slideable member 17 via the interlocking member 24 and the first connecting portion 24*a* of the interlocking member 24 being attached to the first slideable member 17 and contacting with or otherwise engaging the second slideable member 19 adjacent the top of the opening 19*b*.

The second slideable member 19 and first slideable member 17 can both be moveable upwards relative to the rack as the interlocking member 24 is still out of engagement with any step of the steps 16*a* on a first side of the rack and the opening 19*b* is configured to receive the steps of the rack as the second slideable member 19 may move upwards relative to the rack 16. The engagement member 25 can be attached to the side of the second slideable member 19 opposite the side of the second slideable member 19 having opening 19*b* defined therein or can be attached to a side of the second slideable member 19 that is immediately adjacent to the side defining the opening 19*b* (e.g. a side that is to the left or right of the side having the opening 19*b*). The engagement member 25 can be attached to a side of the second slideable member 19 so that it is positioned adjacent to a lower portion of the second slideable member 19 to define the extent to which the second slideable member 19 is moveable vertically upwards within the channel 6*a* of the post 6 relative to the rack 16.

The engagement member 25 can slide along the rack 16 adjacent aperture 16*c* at least partially defined by a second side of the rack that is opposite the first side of the rack having the steps 16*a*. In other embodiments, it is contemplated that the aperture 16*c* can be defined in a side of the rack that is a different side than the side of the rack defining the steps 16*a*, but may not be the side that is opposite the side defining the steps 16*a* and/or otherwise having the steps 16*a*.

The engagement member 25 can be slideable upwards until reaching a blocking member 16*b* attached to an upper end of the rack or integrally formed on the rack adjacent the side of the rack opposite the steps 16*a*. The blocking member 16*b* can be positioned and configured so that when the engagement member 25 contacts or otherwise engages the blocking member 16*b*, the second slideable member 19 is no longer able to move upwards for further extension out of the channel 6*a* of the post 6 such that an uppermost position of the arm pad 11 is defined by the engagement member 25 in cooperation with the blocking member 16, opening 19*b* and interlocking member 24 connected to the first slideable member 17. At this uppermost position, the interlocking member 24 may still be positioned at its uppermost position in the opening 19*b*.

In other embodiments, it is contemplated that the second and first slideable members 17 and 19 may be configured so that the interlocking member 24 may alternatively be positioned adjacent a lower portion of the opening 19*b* of the second slideable member 19 (e.g. at a bottommost position or other lower position in opening 19*b*) or may be positioned at another portion of the opening 19*b* that is below the uppermost position of the interlocking member 24 within the opening 19*b* (e.g. the upward movement of the second slideable member may result in the opening 19*b* being moved upwardly relative to the interlocking member 24 when the first and second slideable members 17 and 19 are both moving upwardly along the second portion of the path of travel defined by the rack 16). For such embodiments, the second slideable member 19 may have another element that is contactable with the steps 16*a* of the rack 16 below the location of the interlocking member 24 to facilitate such motion and still allow both the first and second slideable members 17, 19 to be affixed in their positions by the steps 16*a* of the rack when the actuator is moved to a locked position. It is contemplated that this additional element may be a configuration of the engagement member 25 or may be a second interlocking member connected to the actuator 13 that is moveable into and out of engagement with steps 16*a* via motion of the actuator 13 between its locked and unlocked positions.

After having moved the arm pad 11 to the uppermost position, a user may depress the actuator 13. In response to the user's force being removed from the first end of the actuator 13, the spring member 12 acts on the actuator 13 to cause the actuator to move so that the first end of the actuator moves downwardly away from the arm pad 11 and the second end of the actuator 13 is rotated upwardly to the locked position. The upward motion of the second end of the actuator 13 driven by the spring member 12 causes the adjustment member 18 to move upwardly as well due to its connection to the connector 13*a* of the actuator 13. The upward motion of the adjustment member 18 driven by rotation of the actuator 13 to its locked position drives motion of the interlocking member 24 by driving rotation of the second connecting portion 24*a* about the pivot point defined by the first connecting portion 24*b* within opening 17*b* such that the second connecting portion 24*a* moves along slots 18*a* and 17*a* to its locked position along the arcuate path defined by the slot 17*a*. Rotation of the second connecting portion 24*a* also causes movement of the intermediate portion 24*c* of the interlocking member 24 into contact with and/or engagement with a step 16 of the rack adjacent the location of the interlocking member 24. The engagement of the interlocking member 24 with the step 16*a* of the rack locks the height of the arm pad 11 and prevents the first and second slideable members 17 and 19 from moving upwards or downwards while the actuator is in the locked position.

When a user subsequently desires to reposition the arm pad 11 to a lower location, the user may again move the actuator 13 to move the actuator 13, adjustment member 18, and interlocking member 24 to their unlocked positions and maintain the actuator 13 in its unlocked position so that the interlocking member 24 is rotated out of engagement with the step 16*a* of the rack in which it was previously engaged such that the first and second slideable members 17 and 19 are moveable downwardly. The second slideable member 19 may move downwardly first within the channel of the post 6. During such downward motion of the second slideable member, the engagement member 25 may move along the aperture 16*c* of the rack from the uppermost position of the engagement member to a lowermost position of the engagement member 25. During this downward motion of the second slideable member 19, the interlocking member 24 may move within the opening 19*b* of the second slideable member from adjacent a bottom of the opening 19*b* to adjacent the top of the opening 19*b*. Also during such downward motion of the second slideable member 19, the first slideable member 17 may not move or may move with the second slideable member 19 at the same rate of speed or at a slower rate of speed.

After reaching its bottommost position (and the bottommost position of the engagement member 25), the second slideable member 19 may contact or otherwise engage the interlocking member 24 adjacent the top of the opening 19*b*. To the extent further downward movement of the arm pad 11 is possible depending on the downward travel of the first and second slideable members 17 and 19, the weight of the first and second slideable members 17 and 19, arm pad 11 and other elements can drive further downward motion of the first slideable member 17 within the post 6 and the channel 19*a* to a lower position. Once the first slideable member 17 reaches its lowermost position within the channels 6*a* and 19*a*, the arm pad 11 may be at its lowermost position. A user may then stop pressing on the actuator 13 and the spring member 12 will bias the actuator back to its locked position such that the actuator 13, adjustment member 18, and interlocking member 24 are returned to a locked position. In this regard, the intermediate portion 24*c* of the interlocking member 24 is moved back into contact with or otherwise moved into engagement with a lowermost step of the rack 16 to lock the vertical position of the first and second slideable members 17 and 19 within the post 6.

For vertical adjustments of the arm pad 11 where the second slideable member 19 is not required to extend from the post 6 or retract into the post 6, the vertical adjustment of the arm pad 11, the movement of the actuator 13 can permit the first slideable member 17 to move within the channel 19*a* relative to the rack 16 and second slideable member 19 to different vertical positions defined by the steps 16*a* of the rack 16. The extent of such vertical adjustment can be dependent on the vertical height or length of the opening 19*b* of the second slideable member 19.

In some embodiments, actuator 13 may not be needed to actuate height adjustment. Instead, the steps 16*a* of the rack 13 can be configured to permit upward adjustment of the arm pad 11 and upward movement of the first and second slideable members while preventing the first and second slideable members 17 and 19 to move downwardly without an actuation of an actuator. For instance, the height adjustment mechanism can be configured so that a user may simply push up on the arm pad 11 to drive upward movement of the arm pad by the inclination and shape of the steps 16*a* permitting upward motion of the first and second slideable members and the interlocking member 24. An actuator may be attached to the arm pad and connected to the first and/or second slideable members 17 and 19 so that manipulation of the actuator by a user adjusts a position of the interlocking member 24 to permit the arm pad to be lowered.

In yet other embodiments, both the raising and lowering of the arm pad 11 can be effected without use of an actuator 13. For such embodiments, that may not include actuator 13, the interlocking member 24 may not be configured for any type of rotational movement, the adjustment member 18 may not be included, the spring member 12 may not be included, the connection member 14 may not be included, and the arm pad support member 15 may be configured differently (e.g. not include opening 15*a* and/or aperture 15*b*). The engagement member 25 may also not be included in such an embodiment. For this type of embodiment, the height adjustment mechanism of the armrest 10 can be configured to permit a user to provide an upward force that causes the arm pad to move upwardly and the interlocking member 24 to be moved upwardly along the rack 13. When lowering of the arm pad is desired, the arm pad 11 can be configured to move upwardly to its uppermost position so that the interlocking member 24 is free of the rack and subsequently be slideable all the way to the bottom of the rack 13 before being replaced into engagement with the rack for locking a vertical position of the arm pad. For such an embodiment, lowering of the arm pad could be configured to require the arm pad to be moved beyond its uppermost position so that the interlocking member 24 is moved fully out of engagement with all the steps 16*a* of the rack and is free to subsequently be slid within the channel of the post 6 to a lowermost step 16*a* before becoming reengaged with the steps of the rack. The sizing of elements of the height adjustment mechanism may need to be configured to accommodate spacing within the post 6 for accommodating such movement.

A cover member 20 can be attached to the arm pad support member 15 that includes a body defining an opening to receive and cover upper portions of the first and second slideable members 17 and 19 and an adjustment member 18 to avoid pinch points being exposed to a user. An expandable and retractable cover element 21 can also be connected between the post 6 and the arm pad 11 to hide such pinch points. For instance, the cover element 21 can be attached to the cover member 20 at its upper end and the post 6 at its bottom end so that the cover element 21 expands when the arm pad 11 is moved to a higher location and retracts when the arm pad is moved to a lower position to cover the moveable and extendable first and second slideable members 17 and 19 and adjustment member 18 so that openings and pinch points related to such elements are covered and not exposed for direct contact with a user, who could have a finger or other body part pinched between such elements when those elements move. The cover member 20 and cover element 21 can also function to protect other elements of the armrest 10 from dirt, grime, or other conditions that could cause damage to such components.

It should be appreciated that embodiments of the armrest 10 can be configured differently. For instance, the shape and size of the adjustment member 18, first and second slideable members 17 and 19, arm pad 11, arm pad support member 15, spring member 12, actuator 13, rack 16, interlocking member 24 and engagement member 25 can each be any of a number of different shapes and sizes to meet different design criteria or design objectives. Each of these elements can be formed by only one structure or by multiple interconnected structures that are interconnected via any type of fastening mechanism or combination of such mechanisms. Bolts, screws, adhesives, or other fastening mechanisms can be used to help interconnect or attach different elements together as needed to meet different design criteria as well. As yet another example, the adjustment member 18, first and second slideable members 17 and 19, arm pad 11, arm pad support member 15, spring member 12, actuator 13, rack 16, interlocking member 24 and engagement member 25, cover member 20 and cover element 21 can each be composed of any type of material that can help meet a particular design objective such as a metal, an elastomeric material, a polymeric material, or be composed of a combination of such materials due to the interconnection of different structures formed of different types of materials to form that element.

Therefore, it should be understood that while certain exemplary embodiments of chairs and armrest mechanisms for chairs and methods of making and using the same have been discussed and illustrated herein, it is to be distinctly understood that the invention is not limited thereto but may be otherwise variously embodied and practiced within the scope of the following claims.

What is claimed is:

1. A chair comprising:

a base;

at least one of a backrest supported by the base and a seat supported by the base;

a first armrest attached to at least one of the base, the seat, and the backrest, the first armrest comprising:

a support post attached to at least one of the base, the seat, and the backrest, the support post having a first channel;

a first slideable member positionable in the first channel being moveable within the first channel; and a second slideable member moveably positioned in the first channel, the second slideable member having a second channel, the first slideable member being moveably positioned in the second channel such that the first slideable member is moveable relative to the second slideable member within the second channel from a retracted position to an extended position; and an arm pad attached to the first slideable member, the arm pad being moveable from a lowermost position to an uppermost position; and wherein the second slideable member has an opening in communication with the second channel, and the first armrest further comprising:

a rack attached to the support post, the first and second slideable members being moveable relative to the rack for adjusting a position of the arm pad from an uppermost position to a lowermost position.

2. The chair of claim 1, further comprising:

an engagement member, the engagement member attached to the second slideable member on a side of the second slideable member that is opposite a side of the second slideable member in which the opening of the second slideable member is defined.

3. The chair of claim 2 wherein the rack has a first side having steps and a second side opposite the first side of the rack that at least partially defines an aperture; and the engagement member is attached to the second slideable member such that the engagement member is moveable within the aperture at least partially defined in the second side of the rack.

4. The chair of claim 3 wherein the engagement member is moveable vertically relative to the rack from a lowermost position adjacent a bottom portion of the rack to an uppermost position in which the engagement member engages an upper portion of the second side of the rack or a blocking member attached to an upper portion of the second side of the rack adjacent the aperture of the second side of the rack.

5. The chair of claim 4 comprising an interlocking member that is rotatable from a first position in which a portion of the interlocking member engages a first step of the steps of the rack to a second position in which the interlocking member is released from the first step; and an actuator moveable from a locked position to an unlocked position, the actuator connected to the interlocking member such that the first and second slideable members are moveable relative to the rack when the actuator is moved from the locked position to the unlocked position.

6. The chair of any of claim 5 wherein the second slideable member is moveable after the first slideable member is moved upwards vertically from a lower position relative to the rack when the actuator is in the unlocked position such that a portion of the interlocking member engages the second slideable member adjacent a top of the opening of the second slideable member, the second slideable member being moveable when the portion of the interlocking member engages the portion of the second slideable member adjacent the top of the opening of the second slideable member such that both the first and second slideable members are moved upwards relative to the rack when the second slideable member moves upwardly.

7. A chair comprising:

a base; and at least one of a backrest supported by the base and a seat supported by the base;

a first armrest attached to at least one of the base, the seat, and the backrest, the first armrest comprising:

a support post attached to at least one of the base, the seat, and the backrest, the support post having a first channel;

a first slideable member positionable in the first channel being moveable within the first channel; and a second slideable member moveably positioned in the first channel, the second slideable member having a second channel, the first slideable member being moveably positioned in the second channel such that the first slideable member is moveable relative to the second slideable member within the second channel from a retracted position to an extended position; and an arm pad attached to the first slideable member, the arm pad being moveable from a lowermost position to an uppermost position.

8. The chair of claim 7 comprising:

an actuator moveable from a locked position to an unlocked position, the actuator connected to the first and second slideable members such that:

when the actuator is in the locked position the first and second slideable members being prevented from moving vertically within the first channel, and when the actuator is in the unlocked position, the first and second slideable members being moveable vertically within the first channel such that the first and second members are extendable out of the first channel to adjust the arm pad to the uppermost position of the arm pad and retractable into the first channel to adjust the arm pad to the lowermost position of the arm pad when the actuator is in the unlocked position.

9. The chair of claim 8 wherein the actuator has a first end and a second end opposite the first end, the second end of the actuator having a connector extending therefrom, and the adjustment member having an upper aperture sized to receive the connector of the actuator for attaching the actuator to the adjustment member.

10. The chair of claim 9 further comprising:

a spring member attached to the actuator to bias the actuator to the locked position.

11. The chair of claim 10 wherein the actuator has a plurality of protuberances comprising a first protuberance adjacent a first side of the connector of the actuator and a second protuberance adjacent a second side of the connector of the actuator that is opposite the first side; and wherein the spring member has a first projection spaced apart from a second projection to define an opening between the first and second projections, the first projection being attached to the actuator adjacent to the first protuberance and the second projection being attached to the actuator adjacent to the second protuberance for biasing the actuator to the locked position; and the connector of the actuator extending downwardly from the actuator and through the opening defined between the first and second projections of the spring member.

12. The chair of claim 8 wherein the first armrest further comprises:

an adjustment member attached to the first slideable member between the actuator and the first slideable member, the adjustment member being attached to the first slideable member such that the adjustment member is moveable relative to the first slideable member when the actuator is moved from the locked position to the unlocked position and also being moveable relative to the first slideable member when the actuator is moved from the unlocked position to the locked position.

13. The chair of claim 12 wherein the actuator has a first end and a second end opposite the first end, the second end of the actuator having a connector extending therefrom, and the adjustment member having an upper aperture sized to receive the connector of the actuator for attaching the actuator to the adjustment member; and the first armrest further comprising:

a spring member attached to the actuator to bias the actuator to the locked position.

14. The chair of claim 13, wherein the first armrest further comprising:

an interlocking member having a first connecting portion adjacent a first side of the interlocking member and having a second connecting portion adjacent a second side of the interlocking member that is opposite the first side of the interlocking member;

the first connecting portion rotatably positioned within an aperture defined in the first slideable member;

the second connecting portion passing through a slot defined in a lower portion of the adjustment member and an arcuate slot defined in a lower portion of the first slideable member such that that the second connecting portion is rotatable about the first connecting portion when the actuator is moved from the locked position to the unlocked position, the second connecting portion being moveable within the arcuate slot defined in the lower portion of the first slideable member and the slot defined in the lower portion of the adjustment member when the actuator is moved from the locked position to the unlocked position.

15. The chair of claim 14, wherein the first armrest further comprises a rack attached to the support post within the first channel, the first and second slideable members being moveable relative to the rack for adjusting a position of the arm pad from between the uppermost position and the lowermost position of the arm pad when the actuator is moved to the unlocked position.

16. The chair of claim 15, wherein the rack has a first side having steps attached thereto or formed thereon and a second side opposite the first side, the second side of the rack at least partially defining an aperture; and the first armrest further comprising:

an engagement member attached to the second slideable member on a side of the second slideable member that is opposite a side of the second slideable member in which the opening of the second slideable member is defined such that the engagement member is moveable adjacent the rack within the aperture.

17. The chair of claim 16 wherein the engagement member is moveable vertically relative to the rack from a lowermost position adjacent a bottom portion of the rack to an uppermost position in which the engagement member engages an upper portion of the first side of the rack or a blocking member attached adjacent the upper portion of the first side of the rack; and wherein the interlocking member is rotated from a first position in which a portion of the interlocking member engages a first step of the steps of the rack to a second position in which the interlocking member is released from the first step such that the first and second slideable members are moveable relative to the rack when the actuator is moved from the locked position to the unlocked position.

18. The chair of claim 17 wherein the second slideable member is moveable after the first slideable member is moved upwards vertically from a lower position relative to the rack when the actuator is in the unlocked position such that a portion of the interlocking member engages the second slideable member adjacent at a top of the opening of the second slideable member, the second slideable member being moveable when the portion of the interlocking member engages the portion of the second slideable member adjacent the top of the opening of the second slideable member such that both the first and second slideable members are moved upwards relative to the rack when the second member moves upwardly; and wherein the upper portion of the first side of the rack or the blocking member attached adjacent the upper portion of the first side of the rack engages the engagement member to define the uppermost position of the arm pad.

19. The chair of claim 7, wherein the first slideable member is moveable relative to the support post within the first channel and moves within the second channel and the first channel when the arm pad is moved between the lowermost position and the uppermost position.

20. The chair of claim 19, wherein the second slideable member is moveable within the first channel relative to the support post after the first slideable member is moved upwards within the second channel relative to the second slideable member to the extended position as the arm pad is moved from the lowermost position toward the uppermost position.

21. The chair of claim 20, wherein the first slideable member is configured to move within the second channel such that after the first slideable member is in the extended position, both the first and second slideable members are moved upwards relative to the support post within the first channel when the arm pad is moved to the uppermost position.

22. The chair of claim 21, wherein:

the first slideable member is configured to move within the second channel and the first channel when the arm pad is moved from the uppermost position to the lowermost position such that the first slideable member and the second slideable member move relative to the support post within the first channel along a path of travel until the second slideable member reaches a bottommost position of the second slideable member within the first channel and, after the second slideable member is at the bottommost position in the first channel, the first slideable member moves within the second channel relative to the second slideable member and the support post in the second channel from the extended position to the retracted position within the second channel.

23. The chair of claim 7, wherein:

the first slideable member is configured to move within the second channel and the first channel when the arm pad is moved from the uppermost position to the lowermost position such that the first slideable member and the second slideable member move relative to the support post within the first channel along a path of travel until the second slideable member reaches a bottommost position of the second slideable member within the first channel and, after the second slideable member is at the bottommost position in the first channel, the first slideable member moves within the second channel relative to the second slideable member and the support post in the second channel from the extended position to the retracted position.

* * * * *